United States Patent [19]

Erickson et al.

[11] Patent Number: 4,900,032

[45] Date of Patent: Feb. 13, 1990

[54] BOARD GAME APPARATUS

[76] Inventors: Peggy E. Erickson, 21452 Peggy Joyce La., Saugus, Calif. 91350; Kenneth L. Peterson, 819 Talley La., Lake Havasu City, Ariz. 86403

[21] Appl. No.: 179,831

[22] Filed: Apr. 11, 1988

[51] Int. Cl.[4] ..... A63F 3/00

[52] U.S. Cl. ..... 273/243

[58] Field of Search ..... 273/243, 256, 248, 249, 273/246; 434/127

[56] References Cited

U.S. PATENT DOCUMENTS

| | | | |
|---|---|---|---|
| 4,040,628 | 8/1977 | Pope | 273/243 |
| 4,159,117 | 6/1979 | Kuna | 273/243 |
| 4,174,840 | 11/1979 | Curtiss | 273/248 |
| 4,522,407 | 6/1985 | Hatherly | 273/256 |

FOREIGN PATENT DOCUMENTS

| | | | |
|---|---|---|---|
| 2380044 | 10/1978 | France | 273/243 |
| 2501053 | 9/1982 | France | 273/236 |

*Primary Examiner*—Edward M. Coven

*Assistant Examiner*—Benjamin Layno

*Attorney, Agent, or Firm*—Roger A. Marrs

[57] ABSTRACT

A game board apparatus is disclosed herein, including a flat board having a playing surface marked with concentric separated tracks composed of playing spaces placed end-to-end along the length of each track. Certain playing spaces are specially marked to indicate a special event or change of play according to the rules of play. The playing tracks are laid out in a symmetrical pattern with the special event spaces interconnecting the concentric tracks at spaced apart intervals along the respective tracks. Subtracks are connected to a selected one of the concentric tracks useful as a delay or penalty area employed by the players during a course of play. Game pieces are employed for player movement along the playing tracks, and chance determining devices such as dice are used to determine the number of playing spaces advanced or retracted by the respective player's game pieces. Penalty and award spaces or cards are used according to the rules for enhancing player interest during the course of play.

1 Claim, 2 Drawing Sheets

FIG. 1.
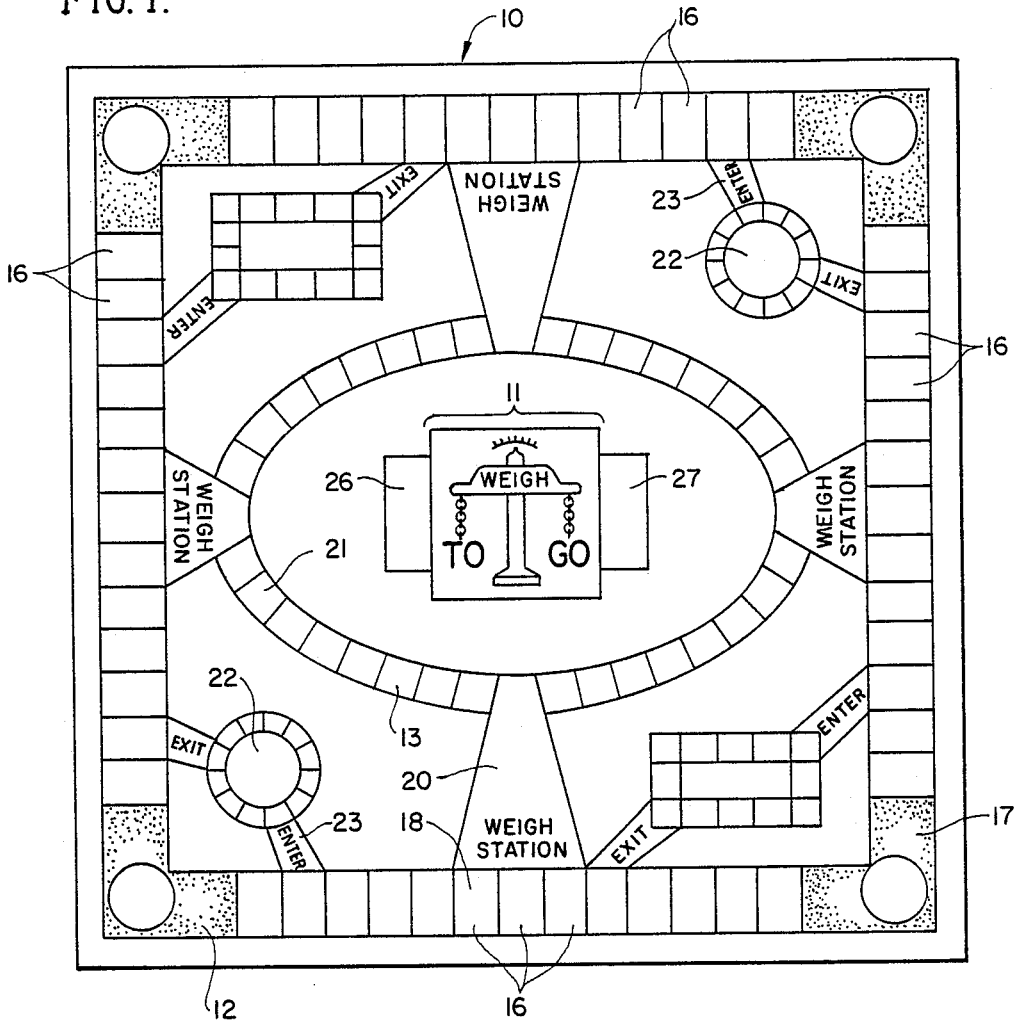
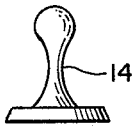
FIG. 2.
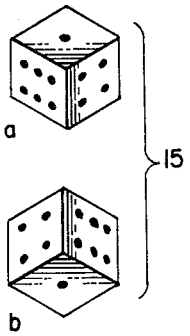
FIG. 3.
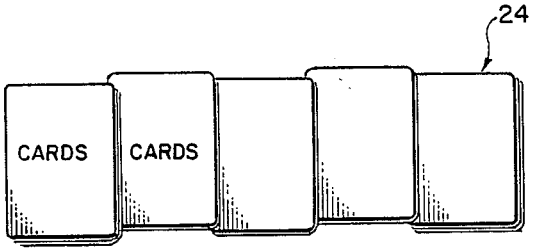
FIG. 4.
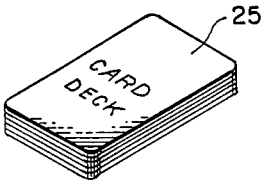
FIG. 5.

31

| WEIGHT CHART | | | | | | |
|---|---|---|---|---|---|---|
| | WOMEN | | | MEN | | |
| HEIGHT | S | M | L | S | M | L |
| 4'-10" | 95 | 100 | 111 | 105 | 112 | 122 |
| 4'-11" | 97 | 104 | 114 | 107 | 114 | 124 |
| 5'-0" | 100 | 107 | 117 | 110 | 117 | 127 |
| 5'-1" | 103 | 110 | 120 | 113 | 120 | 130 |
| 5'-2" | 106 | 113 | 123 | 116 | 123 | 133 |
| 5'-11" | 139 | 147 | 158 | 149 | 157 | 169 |
| 6'-0" | 143 | 151 | 163 | 153 | 162 | 174 |
| 6'-1" | 147 | 155 | 167 | 157 | 166 | 178 |
| 6'-2" | 151 | 159 | 171 | 161 | 170 | 182 |
| 6'-3" | 155 | 163 | 175 | 165 | 174 | 186 |

BOARD GAME APPARATUS

BACKGROUND OF THE INVENTION

1. Field of the Invention

The present invention relates to game board apparatus and more particularly to novel apparatus of such a type in which the board bears characteristic dietary data of distinctive caloric value whereby various combinations of values are accumulated by the players which determine the outcome of the game and whereby original, unique, and instructive games combining skill and chance may be devised.

2. Brief Description of the Prior Art

Game boards have been provided in the past which have included a single course or path which is shared by many players as the players position or move tokens indicative of their play in response to some form of chance determining means such as a spinner, cards, dice, etc. The chance determining means usually indicates the length of move along the path or course and the player first reaching the end of the course is declared the winner. However, such conventional games do not allow for a high degree of player skill to be employed in determining the player's length of move along the path or course in order to reach the terminating end of the path or course with the highest score. Furthermore, inasmuch as a single path or course is provided, the outcome of conventional games does not depend on a "winning" combination of values such as may be provided by employing multiple paths or courses that are played simultaneously by each of the individual players upon the occasion of taking their turn. Consequently, most conventional games fall short of achieving intellectual stimulation in combination with chance determining means which will allow for a wide variety of games to be played upon a single board.

Furthermore, conventional games do not couple the information useful in playing the game with the players' conduct, lifestyle or living habits experienced during the day. In other words, a long standing need has existed to provide a novel game constituting an educational experience wherein data such as dietary information employed by the players during a course of play can be used by each player in conducting their respective daily lives. Such dietary information may take the form of caloric intake assigned to a variety of foods as well as caloric usage while engaged in certain physical activities. By using relatively exact caloric values for determining the outcome of a game, these same values are useful by each player in determining his or her own control of weight gain or loss on an actual daily basis.

SUMMARY OF THE INVENTION

Accordingly, the game board apparatus of the present invention provides a board having caloric value designated playing spaces constituting multiple continuous and concentric paths or courses upon which multiple tokens controlled by a particular player may be selectively moved in order to establish combinations of caloric values wherein the player combination of least value is deemed to determine the outcome of the game, regardless of whether he completes the course first or last. Special spaces are provided which interconnect at least two concentric playing paths or courses so that player game pieces or tokens travel from one path or course to the other path or course depending on rules of play. The term "value" as employed herein is intended to include various designations relating to weight gain or loss in terms of pounds or caloric intake affected by dietary habits and/or physical activity such as numeric, face playing cards, letters of the alphabet, pictures and the like. Chance determining means including dice and chance cards are provided for indicating the number of playing spaces to be covered and, in some cases, whether the movement is to be forward, rearward or none at all for a particular player's turn. A feature of the present invention resides in the provision for introducing directional cards for instructing the player of various move choices or which grant him certain penalties, awards or benefits. Furthermore, a feature resides in the provision of player reference weight chart and a memory or record means separate from the board for recording the various combinations of pounds and caloric values which an individual player may achieve during the course of play along the multiple paths or courses.

Therefore, it is a primary object of the present invention to provide a novel board game apparatus having multiple concentric playing paths or courses interconnected by special spaces which are simultaneously played upon by individual players during their turn for action to effect playing combinations having different values such as caloric or poundage values.

It is another object of the present invention to provide a novel dietary board game apparatus having playing spaces or areas of different caloric values upon which an individual player moves his or her token responsive to chance determining means so as to effect a "winning" combination of caloric values according to the record summary of collected designated caloric values.

Still another object of the present invention is to provide a novel dietary board game apparatus displaying a number of alphanumeric, alphabetic characters or graphic representations arranged in separate paths or courses which are simultaneously played by individual players whereby the outcome of the game is dependent upon chance and player's skill to develop a "winning" combination of caloric values representing player weight loss during the term of play.

A still further object of the present invention is to provide a novel weight loss game board apparatus having memory means for recording various combinations of caloric or poundage values achieved by individual players as the game progresses along multiple playing paths or courses which display spaces or areas having different designated caloric or poundage values.

Still another object of the present invention is to provide apparatus for playing weight loss and dietary games in the use of which the outcome of the game is not entirely dependent upon the skill of the respective players in that certain elements of chance are involved in the playing of the game.

A further object of the present invention is to provide a novel weight loss or dietary game board displaying a number of different caloric values and chance determining means which may be employed to play various highly amusing and interesting dietary games involving both physical activity and dietary caloric information and which, at the same time, involves sufficient player's skill to render attention, alertness and resourcefulness a large factor in the playing of the game.

Another object resides in a dietary game incorporating weight loss and weight gain information such as calories gained or lost through diet consumption and physical exercise that is useful to the player after conclusion of the game during the player's daily life.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a top plan view of one form of the game board apparatus incorporating the present invention;

FIG. 2 is a view in elevation of a typical token or game piece used by players to indicate player moves and current player positions on the playing field of the board in relation to each player;

FIG. 3 is a perspective view of dice employed as a chance determining means to determine the length of player token move along the playing path, track or course;

FIG. 4 represents a set of direction cards imprinted with alpha/numeric or graphic representations indicating instructions or directions drawn by a player in the course of the game which impose penalties or benefits on the players according to the rules of play;

FIG. 5 represents a set or deck of cards displaying caloric values which when selected by a player, the caloric value is added to his or her total;

DESCRIPTION OF PREFERRED EMBODIMENT

Figures 6, 7:
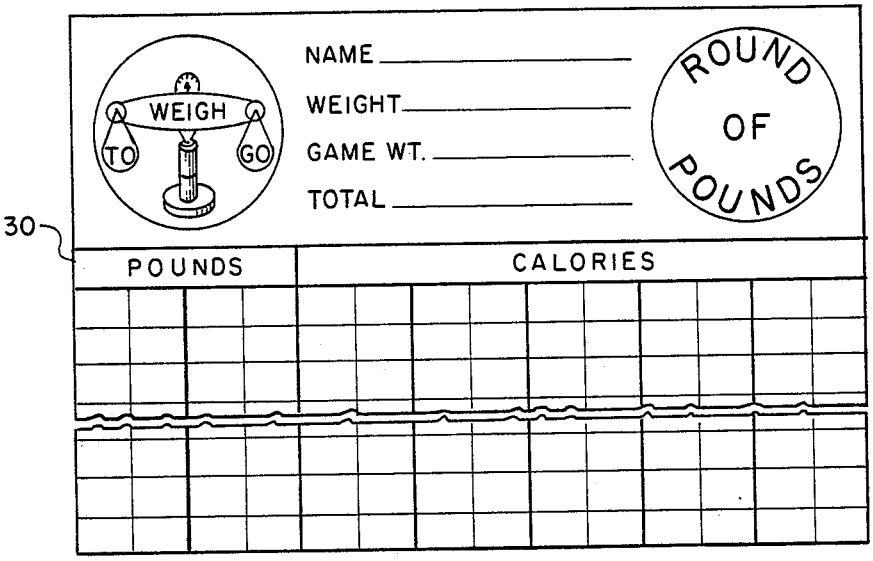
FIG. 6 is a reduced view of a weight poundage/caloric value summary sheet used by each player to maintain a running record of values received during the course of play.
FIG. 7 represents a weight chart showing typical body weight for women and men keyed to an individual's height.

Referring to FIG. 1, the layout of a board as a whole is indicated by the numeral 10. Inasmuch as the game is known as WEIGH-TO GO, that name is indicated by numeral 11 on the board in a central display area thereof. A path or course of play is made up of an inner and an outer track of square and oval configuration respectively wherein the oval inner track is concentric with and disposed within the confines of the square outer track. The outer track is indicated by numeral 12, while the inner track is indicated by numeral 13. Each of the tracks constitute a continuous path, course or circuit about which playing symbols or tokens of the players are moved according to the throws of dice as long as the game continues. The game pieces or tokens are illustrated in FIG. 2, indicated by numeral 14. FIG. 3 illustrates the chance determining means which, in the present instance, takes the form of a pair of dice 15. Each die includes numeric information displayed on a flat surface, which indicates player token advancement along a given track.

The square outer track 12 includes a plurality of playing spaces, such as space 16, that is unadorned and each of the playing spaces is arranged in end-to-end configuration in a continuous manner. Selected ones of the playing spaces include certain graphic characteristics or indicia related to dietary caloric values as well as instructions related to advancement or retardation of token movement. Each corner 17 of the square geometric configuration of the outer track is of a square shape having a circular inset and is placed with a penalty award. The starting point is indicated by numeral 18 on a special event area marked WEIGH STATION by numeral 20.

It is also to be noted that the oval inner track 13 includes playing spaces 21 carrying numerical caloric value related to athletic or physical activities as well as instructions. Respective playing spaces are arranged in the inner and outer tracks by being placed in end-to-end alignment and such playing spaces also include special event spaces 20 arranged in spaced apart relationship interconnecting the inner track with the outer track. The layout of the game board includes special event spaces 20 which include a plurality of playing spaces in alignment so as to connect the respective midsections of the inner and outer tracks so that player token movement can be taken between tracks.

At certain board areas between the tracks 13 and 20 special areas or locations are displayed having numerical caloric valued playing spaces 22. The respective numbered spaces 22 represent high caloric foods and are connected to the outer track as a subtrack effective to move a player's token from the normal transverse of the outer track. This operates as a delay means for that particular player and a typical subtrack area is identified by numeral 23.

The means of determining the number of steps or moves a player shall take is accomplished by the roll of a pair of dice 15. A set of cards 24 are specifically designated to reflect whether the player takes no steps forward, takes one step, takes two steps, three or four steps forward, or, whether the player backs up one or two steps and whether the player must go all the way back and start all over again when his or her turn comes up again. The cards can display caloric values which benefit or penalize the player. Another set of cards 25 display caloric information values only.

Chance determining means also take the form of cards 24 wherein one of several cards carrying caloric values are arranged in a stack on the board layout in an area indicated by numeral 26. A player will draw a card from the stack when directed and the card will contain the caloric value to be used for calculating advancement along the separate tracks or track segments. Another area on the layout is indicated by numeral 27 on which is displayed a stack of caloric value cards 28. These cards represent weight loss or gain in terms of the amount of caloric value indicated. One of these cards are chosen by direction of instruction on a playing space or by a card 24.

A summary sheet 30 is illustrated which includes a plurality of rows and columns for displaying pounds and calories awarded during the course of play. Each player has a summary sheet on which to record caloric values and pounds as they are awarded or gained or lost by the player.

A weight chart 31 is included showing typical weight for individuals according to height and gender.

RULES OF PLAY

The object of the game is for each player to lose the most pounds below a particular player weight at the finish of the game.

TO START

Round of Pounds Summary Sheets:

Each player takes a Round of Pounds sheet 30. This sheet is to keep track of the pounds and calories a player gains and loses. Unless directed to do so, players should not reveal their totals to other players. When you think a player is getting close to losing the game weight, that may be the time to try to block them and add pounds to their score. If you have gained more than 3500 calories, then add 1 pound to the pounds column. The same principal applies if you have lost 3500 calories. You can have a negative number in the columns.

3500 CALORIES=1 POUND
1750 CALORIES=½ POUND
875 CALORIES=¼ POUND

Choose a playing piece and place it on any of the 4 Weigh Station circles to "WEIGH IN". Each player chooses their weight from the Weight Chart 31. Choose the game pounds and add to your weight. This is your total weight. Write this onto the "ROUND OF POUNDS" sheet. Put the total weight in the pounds column next to start. Example of game pounds: approximately 1½ hours to lose 20 pounds. You determine game length by the amount of pounds everyone adds to their weight. If you want a short game, try adding 10 pounds to your weight. If you want to spend your vacation, try a 300 pound game, or anything in between.

Everyone rolls one die to determine the player that starts. Player to the left rolls next.

MOVEMENT

Two dice 15 are used at all times during the game.

Direction

All movement on the board is in a clockwise direction unless specified by a square.

Weigh Station Squares 20:

Always move through the scale circle to the farthest clockwise Weigh Station square 20.

Landing on a Weigh Station square 20 on the outer board, you MAY move into the Fat Farm. You don't have to go into the Fat Farm but I cannot understand why you wouldn't. The Fat Farm is where you lose most of your pounds.

Landing on a Weigh Station square in the Fat Farm, you MUST move to the outer board Weigh Station square.

Moving To A Weight Gain Area:

You must move to the weight gain area at the same time you are directed, either by a card or square. If you have another roll left you must take it when you arrive at your destination.

If you are in a weight gain area, for example: Donut Delight, and a player or card sends you to Donut Delight, move to the enter square.

Rolling Doubles:

Roll doubles and subtract 1 pound immediately, then move your playing piece. If you roll doubles and land on a roll again square, you now have 2 more rolls. You could roll all night and win. If you get sent somewhere while rolling doubles, you still have a roll.

Landing of Another Player:

There is no penalty;

CARDS

Calorie Cards 28:

Calorie cards add calories to your score. Some are low calorie foods and some foods are high in calories. Add the amount to your Round of Pounds sheet.

Fat Chance Cards 24:

Each time you land on a Weigh Station square, take 1 Fat Chance card.

We could list a bunch of Fat Chance cards and tell you what to do with them, but then you wouldn't have to read them, and we might as well play the game instead of you. I will tell you though, you cannot give a card to a player in a Weigh Station. When you use "Use or Save" cards, it must be at the beginning of your turn. If you get caught with these cards giving pounds at the end of the game, you get to add those pounds to your own weight.

Reveal Your Weight or Weigh in Cards:

When you get one of these cards, you must tell everyone (1) The weight you chose to start the game;
(2) The amount of pounds on your Round of Pounds;
(3) The amount of calories you have.

WEIGH OUT! OR END OF GAME

Once you realize that you are below your starting Weight Chart weight, head for the nearest Weigh Station to Weigh Out. When and if you can get there, and you might not make it before you gain more weight, yell out, "WEIGH OUT!" Each player gets one more turn to try and lose, usually gain, a few more pounds. Total your calories and pounds for your Weigh Out.

THE WINNER

The winner of the game is the person who has lost the most pounds and calories below your "Weight Chart Weight". This will include your calories.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A dietary board game apparatus comprising the combination of:

a flat board having planar surfaces wherein a selected planar surface carries a playing layout;

said playing layout defined as having a plurality of endless traacks or courses arranged in predetermined locations on said board planar surface in spaced-apart relationship;

player tokens adapted to move along each of said tracks or courses between said start and said completion position;

chance determining means for effecting the movement of said tokens so as to determine the length of travel of each token along said playing spaces of said track;

penalty means associated with said chance determining means for modifying the advancement of said player tokens along said track or course playing spaces;

said plurality of tracks or courses comprise at least two continuous tracks of playing spaces arranged in squares having an inner oval surrounded by an outer square track of four segments in spaced relationship thereto;

endless special event tracks of playing spaces interconnecting said playing spaces of said tracks;

said special event tracks of playing spaces arranged in at least four locations in substantially equal distance apart so that entry and exit spaces of one special event track extends between portion of said outlet square segments across each corner of said square track; and selective ones of said playing spaces are designated by dietary caloric values.

* * * * *